US008042501B2

(12) United States Patent
Kim et al.

(10) Patent No.: US 8,042,501 B2
(45) Date of Patent: Oct. 25, 2011

(54) CONTINUOUSLY VARIABLE VALVE LIFT APPARATUS

(75) Inventors: Back Sik Kim, Osan (KR); Ingee Suh, Yongin (KR); Dong Hee Han, Seoul (KR); Wootae Kim, Suwan (KR); Hyung Ick Kim, Gumpo (KR); Myungsik Choi, Seoul (KR); Dae Sung Kim, Hwaseong (KR); Kyoung Pyo Ha, Suwan (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 189 days.

(21) Appl. No.: 12/533,518

(22) Filed: Jul. 31, 2009

(65) Prior Publication Data

US 2010/0139588 A1 Jun. 10, 2010

(30) Foreign Application Priority Data

Dec. 4, 2008 (KR) ..... 10-2008-0122762

(51) Int. Cl.
*F01L 1/34* (2006.01)

(52) U.S. Cl. ..... 123/90.16; 123/90.39; 123/90.44; 74/569

(58) Field of Classification Search ..... 123/90.16, 123/90.39, 90.44; 74/559, 567, 569
See application file for complete search history.

(56) References Cited

U.S. PATENT DOCUMENTS 6,705,257 B2 * 3/2004 Shimizu ..... 123/90.15

* cited by examiner

*Primary Examiner* — Ching Chang
(74) *Attorney, Agent, or Firm* — Morgan, Lewis & Bockius LLP

(57) ABSTRACT

A continuously variable valve lift apparatus may include a control shaft, a camshaft in which a cam is formed thereto, an eccentric member connected to the control shaft, a follower slidably contacting the cam, a follower arm that is extended from a follower ring mounted around the eccentric member, a variable ring slidably mounted on the eccentric member and a variable arm extended from the variable ring, an output ring slidably mounted on the control shaft and an output arm extended from the output ring, wherein an output cam is integrally formed to the output arm and an end portion of the output cam is pivotally coupled to one end portion of the output arm, a first link pivotally connecting the follower arm and the variable arm, and a second link pivotally connecting the variable arm and the output arm.

16 Claims, 6 Drawing Sheets

CONTINUOUSLY VARIABLE VALVE LIFT APPARATUS

CROSS-REFERENCE TO RELATED APPLICATION

The present application claims priority to Korean Patent Application Number 10-2008-0122762 filed Dec. 4, 2008, the entire contents of which application is incorporated herein for all purposes by this reference.

BACKGROUND OF THE INVENTION

1. Field of the Invention

The present invention relates to a continuously variable valve lift apparatus. More particularly, the present invention relates to a continuously variable valve lift apparatus for varying the lift amount of a valve corresponding to driving conditions of an engine.

2. Description of Related Art

An internal combustion engine generates power by burning fuel in a combustion chamber in an air media that is drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

An optimal operation of the intake valves and the exhaust valves depends on a rotation speed of the engine. That is, an optimal lift or optimal opening/closing timing of the valves depends on the rotation speed of the engine. For example, research has been undertaken for a variable valve lift (VVL) apparatus that enables different lifts depending on engine speed, and for a variable valve timing (VVT) apparatus that opens/closes the valves with different timing depending on the engine speed.

For such a VVL apparatus, it is recommended that power loss in driving the valves using torque of the camshaft is minimized. In addition, it is recommended that the VVL apparatus is symmetrically designed such that it may be symmetrically installed in both banks in a V-engine.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a continuously variable valve lift apparatus having advantages of achieving a variety of areas in which a valve moves.

A continuously variable valve lift apparatus may include, a control shaft configured to be in parallel with a camshaft in which a cam is formed at one side thereof; an eccentric member in which an insertion hole through which the control shaft penetrates is formed, and an eccentric exterior circumference is formed at an exterior circumference thereof to center on the center of one circle that is eccentric from the center of the insertion hole; a roller type of follower that is mounted on the end portion of a follower arm that is extended from a follower ring that is mounted in the eccentric member and that closely contacts the cam; and a variable ring that is slidably mounted on the eccentric member, with a variable arm that is extended from the variable ring, wherein the press amount of the swing arm or timing thereof is varied by the variable arm that moves in a center direction of the control shaft or in an opposite direction thereof corresponding to the rotation of the control shaft.

The eccentric exterior circumference may include a first eccentric exterior circumference that corresponds to a circle that is larger than a diameter of the insertion hole to be formed in the exterior circumference of the eccentric member based on a second center eccentric from a first center of a circle following the interior circumference of the insertion hole, and a second eccentric exterior circumference that corresponds to a circle that is larger than a diameter of the first eccentric exterior circumference to be formed in the exterior circumference of the eccentric member based on a third center eccentric from the second center, wherein the follower ring is slidably mounted on the first eccentric exterior circumference, and the variable ring is slidably mounted on the second eccentric exterior circumference.

The continuously variable valve lift apparatus may further include a variable pin that is mounted on an end portion of the variable arm, a first link that connects a fixed pin, which is fixed to the follower arm in the lower portion of the follower, to the variable pin, an output ring that is adjacent to the eccentric member to be slidably mounted on the exterior circumference of the control shaft, an output arm that is extended from the output ring, and an output cam in which a contact surface is formed in one side surface of the lower end of the output arm to press a swing arm.

The fixed pin may be mounted on one side of the follower arm, the moving pin is fixed on one side of the output arm, and the variable pin is disposed between the fixed pin and the moving pin, further including a second link configured to connect the fixed pin with the variable pin, and corresponding to the rotation direction of the control shaft, the variable pin moves in the center direction of the control shaft or in the opposite direction thereof such that the moving pin becomes near the fixed pin or moves away therefrom.

The second eccentric exterior circumference may be formed in the middle of the length direction of the eccentric member, and the first eccentric exterior circumference is respectively formed at both sides of the second eccentric exterior circumference.

The first center, the second center, and the third center may be sequentially disposed in a straight line with a predetermined distance from each other.

Corresponding to one cam, the one variable ring may be mounted on the second eccentric exterior circumference, and the two follower rings are mounted on the first eccentric exterior circumferences that are formed at both sides of the second eccentric exterior circumference.

The moving pin is extended in a length direction of the control shaft to connect output arms, which are disposed at both sides of the eccentric member, with each other.

The follower arms are respectively extended from the two follower rings, the follower arms are connected with one pin, and the follower is mounted to the one pin.

The continuously variable valve lift apparatus may further include an elastic member that elastically supports one side of the moving pin for the follower to contact one surface of the cam.

A continuously variable valve lift apparatus may include, a control shaft configured to be disposed in parallel with a camshaft with a cam formed at one side thereof, an eccentric member in which an insertion hole through which the control shaft is inserted is formed, a first eccentric exterior circumference is formed in the exterior circumference based on a second center eccentric from the first center of the circle following the interior circumference of the insertion hole corresponding to the circle that is larger than the diameter of the insertion hole, and a second eccentric exterior circumference is formed in the exterior circumference based on a third center eccentric from the second center; a roller type of follower that is mounted on the end portion of the follower arm that is extended from the follower ring that is slidably engaged with the first eccentric exterior circumference to closely contact the cam; and a variable pin that is mounted on the end portion of the variable arm that is extended from the variable ring that is slidably engaged with the second eccentric exterior circumference, wherein the pressed amount of the swing arm or the press timing thereof is varied by the variable arm that moves in a center direction of the control shaft according to the rotation direction of the control shaft.

The continuously variable valve lift apparatus may further include a first link that connects a fixed pin that is fixedly mounted on the follower arm of the lower side of the follower to the variable pin, an output arm that is disposed adjacent to the eccentric member to be extended from the output ring that is slidably mounted on the exterior circumference of the control shaft, and an output cam with a contact surface formed in one side of the output arm to press a swing arm.

The continuously variable valve lift apparatus, may further include a control shaft configured to be in parallel with a camshaft in which a cam is formed thereto; an eccentric member connected to the control shaft and including at least an eccentric exterior circumference formed at an exterior circumference thereof, wherein center axes of the at least an eccentric exterior circumference are offset from a rotation axis of the control shaft; a follower that is configured to slidably contact the cam, the follower being mounted on an end portion of a follower arm that is extended from a follower ring mounted around one of the at least an eccentric member; a variable ring that is slidably mounted on the other of the at least an eccentric member and a variable arm is extended from the variable ring; an output ring that is slidably mounted on the control shaft and an output arm is extended from the output ring, wherein an output cam is integrally formed to the output arm and an end portion of the output cam is pivotally coupled to one end portion of the output arm; a first link pivotally connecting the other end portion of the follower arm and an one end portion of the variable arm; and a second link pivotally connecting the one end portion of the variable arm and the one end portion of the output arm, wherein the output cam includes a contact surface to press a swing arm and a press amount of the swing arm or timing thereof is varied by the variable arm that is rotatably controlled by the control shaft.

The continuously variable valve lift apparatus may further include an elastic member that biases the one end portion of the output arm toward the camshaft.

As described above, the continuously variable valve lift apparatus according to various embodiments of the present invention effectively continuously adjusts the lift amount of the valve.

The valve lift amount of the engine is controlled to be less in a low load driving condition such that fuel consumption can be reduced.

Further, as the lift amount of the valve decreases, the timing of the maximum lift is advanced such that the pumping loss of the cylinder decreases, and the CVVL has a compact structure to be easily applied to an engine such that the product marketability is improved.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
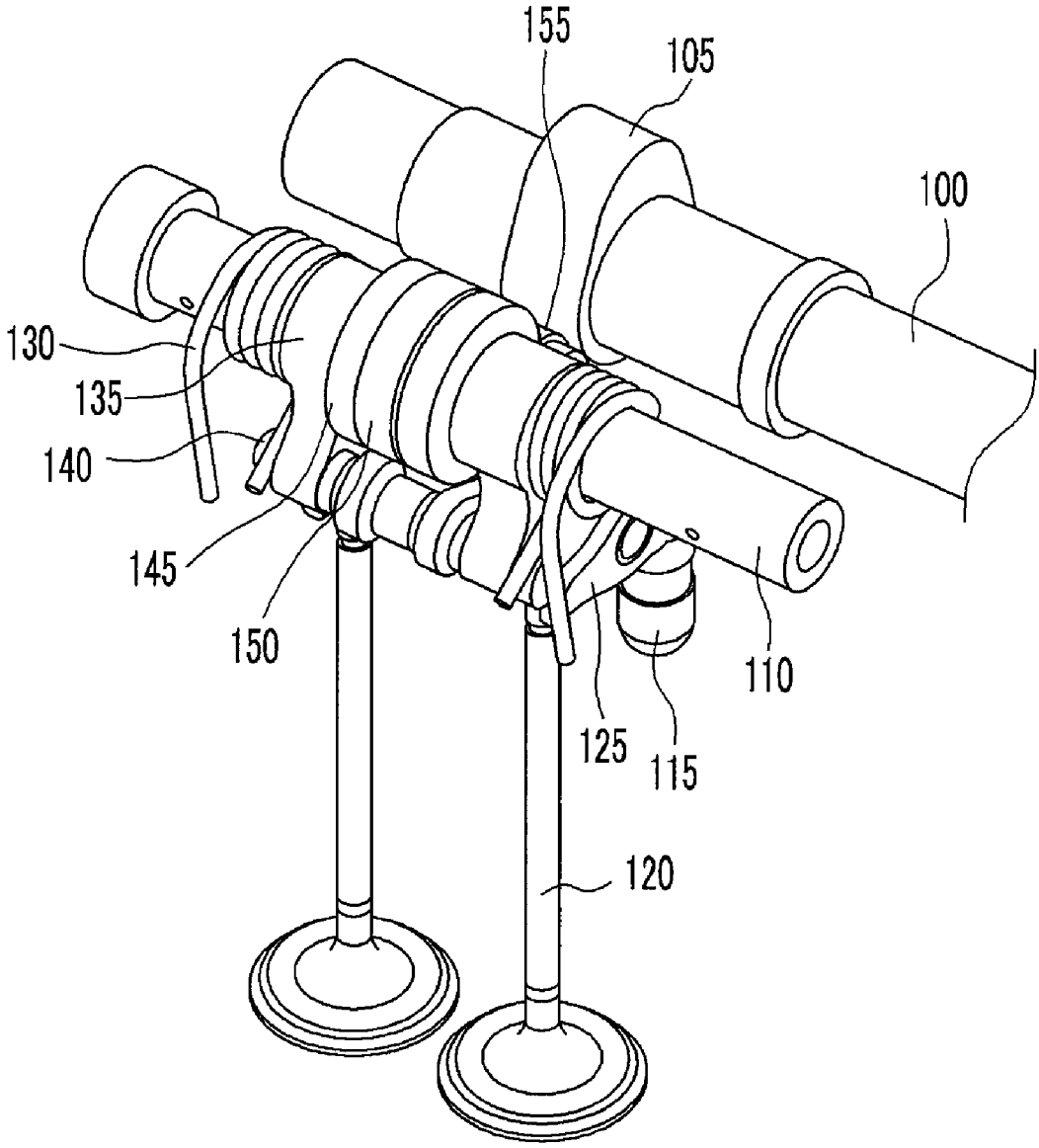
FIG. 1 is a perspective view of an exemplary continuously variable valve lift apparatus according to the present invention.
Figure 2:
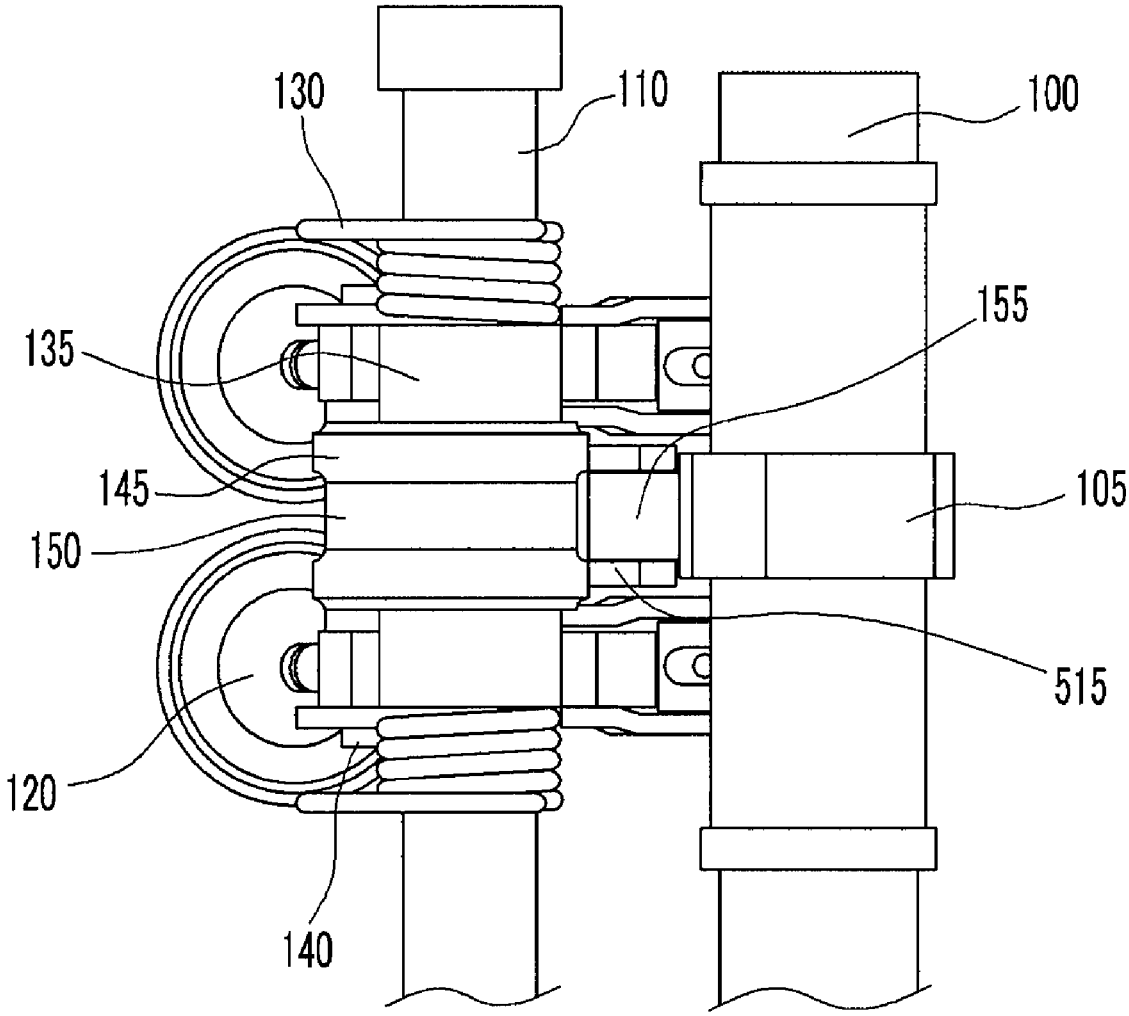
FIG. 2 is a top plan view of an exemplary continuously variable valve lift apparatus according to the present invention.

FIG. 1 is a perspective view of a continuously variable valve lift apparatus according to various embodiments of the present invention, and FIG. 2 is a top plan view of a continuously variable valve lift apparatus according to various embodiments of the present invention.

Referring to FIG. 1, a continuously variable valve lift apparatus includes a camshaft 100, a cam 105, a control shaft 110, a support 115, a valve 120, a swing arm 125, an elastic member 130, an output ring 135, a moving pin 140, a follower ring 145, a variable ring 150, and a follower 155.

The cam 105 is formed on the camshaft 100, and the control shaft 110 is disposed in parallel with the camshaft 100. The control shaft 110 is slidably inserted through the follower ring 145, the follower 155 is formed on the end portion thereof, and the follower 155 elastically contacts the outside surface of the cam 105.

The output ring 135 is adjacent to the follower ring 145 to be slidably mounted on the control shaft 110, and the output ring 135 rotates based on the center of the control shaft 110 according to the movement of the follower 155 to lift the swing arm 125 and the valve 120 on the basis of the support 115.

However, according to the rotation position of the control shaft 110, the position of the variable ring 150 is raised or lowered to vary the lift amount of the valve 120.

Referring to FIG. 2, the variable ring 150 is positioned between the two follower rings 145 on the control shaft 110. Here, the follower 155 is mounted centering around a pin that is disposed on an end portion that is extended from the follower ring 145.

An output ring 135 is mounted at each side of the two follower rings 145, and two valves are pressed according to the movement of the two output rings 135.

Figure 3:
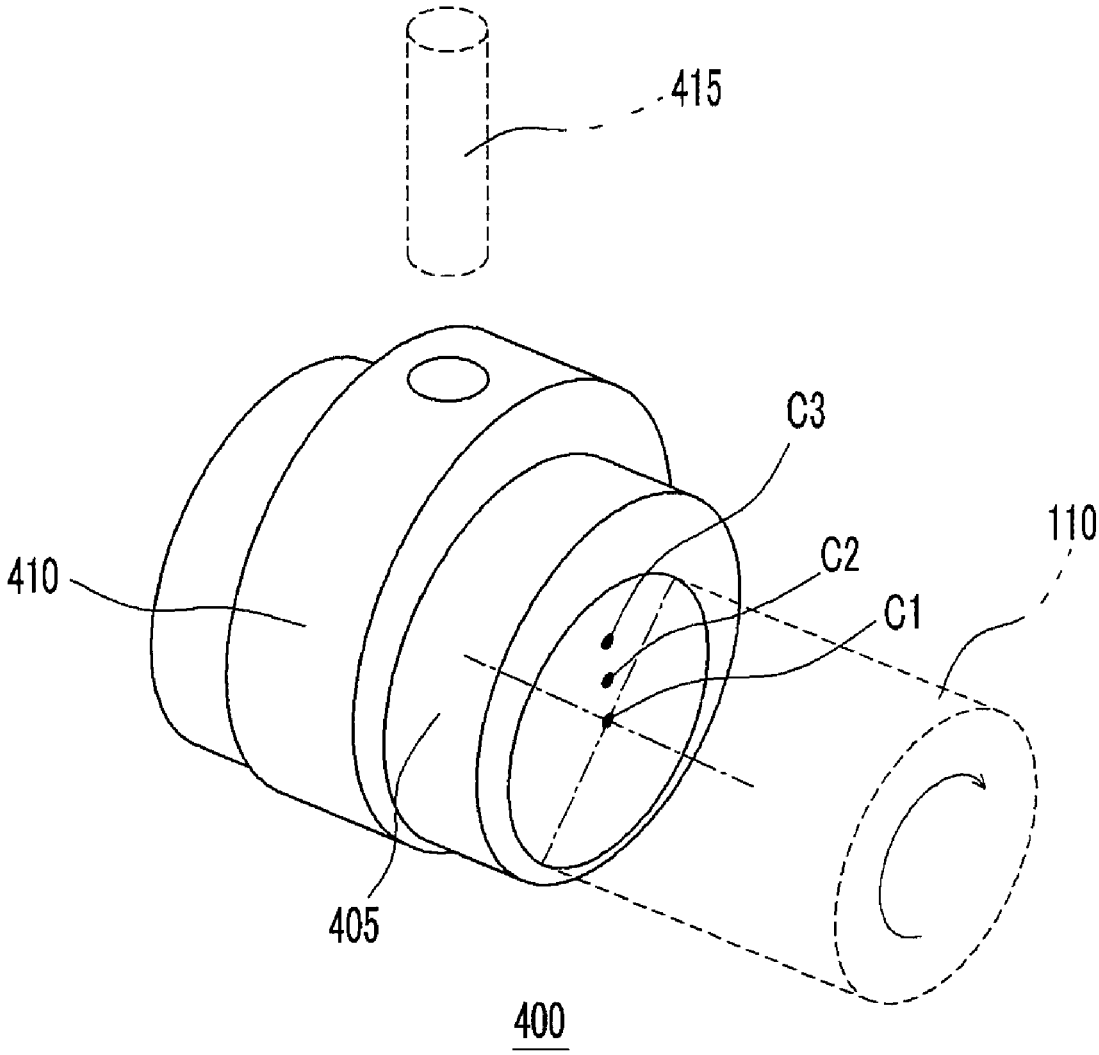
FIG. 3 is an exploded perspective view of an exemplary eccentric member that is provided with a continuously variable valve lift apparatus according to the present invention.

FIG. 3 is an exploded perspective view of an eccentric member that is provided with a continuously variable valve lift apparatus according to various embodiments of the present invention.

An eccentric member 400 is mounted on the control shaft 110, and the variable ring 150 and the follower ring 145 are rotatably mounted on the eccentric member 400.

Referring to FIG. 3, a penetration hole through which the control shaft 110 penetrates is formed, and a circle corresponding to the interior circumference of the penetration hole has a first center C1.

A first eccentric exterior circumference 405 and a second eccentric exterior circumference 410 are formed on the exterior circumference of the eccentric member 400, a circle corresponding to the first eccentric exterior circumference 405 has a second center C2, and a circle corresponding to the second eccentric exterior circumference 410 has a third center C3.

When the first center C1, the second center C2, and the third center C3 are positioned at one plane of the same position in a length direction of the control shaft 110, the first center C1, the second center C2, and the third center C3 are spaced apart with a predetermined gap therebetween.

Particularly, in various embodiments of the present invention, the first center C1, the second center C2, and the third center C3 are sequentially disposed from the first center C1 of the control shaft 110, that is, the C1, C2, and C3 centers are disposed in a straight line.

Further, the control shaft 110 and the eccentric member 400 are fixed to each other with a fixing pin 415 such that the control shaft 110 and the eccentric member 400 rotate together.

If the control shaft 110 rotates 180 degrees in an arrow direction in a FIG. 3 condition, the second center C2 and the third center C3 are lowered with respect to the first center C1.

Accordingly, the position of the follower ring 145, which is mounted on the first eccentric exterior circumference 405, moves to the lower side, and the position of the variable ring 150, which is mounted on the second eccentric exterior circumference 410, moves to the lower side.

Figure 4:
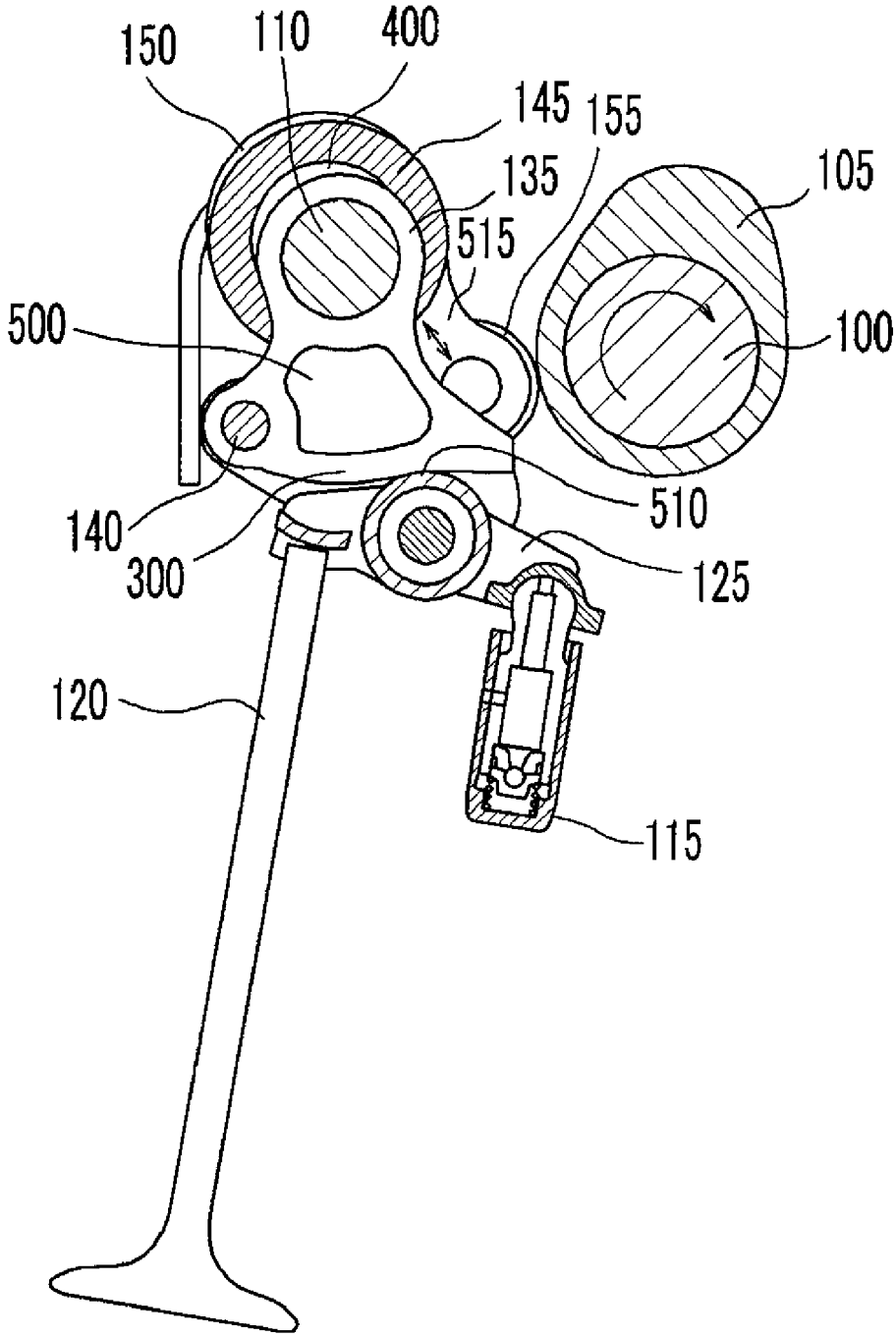
FIG. 4 is a first partial cross-sectional view showing an operation principle of an exemplary continuously variable valve lift apparatus according to the present invention.
Figure 5:
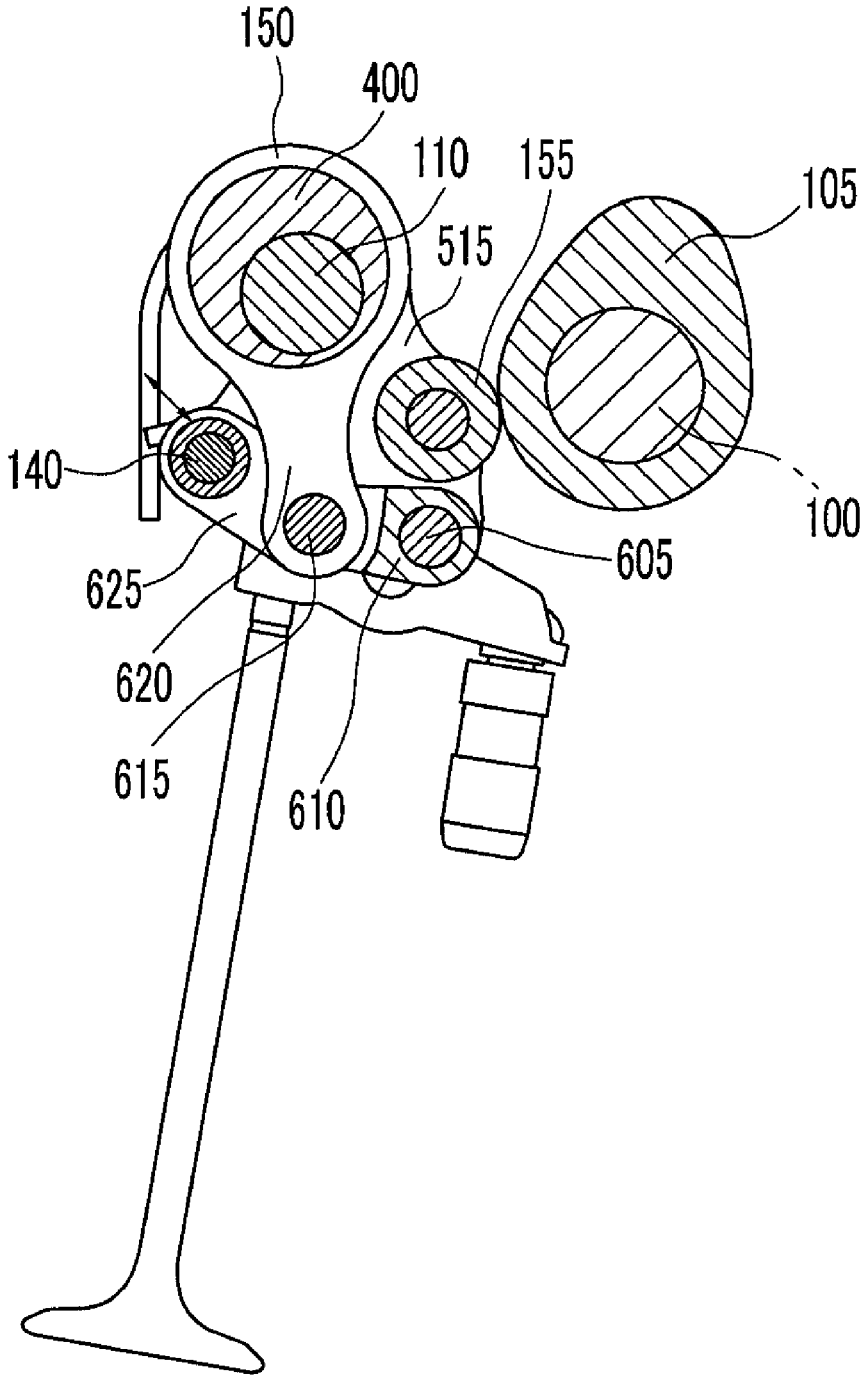
FIG. 5 is a second partial cross-sectional view showing an operation principle of an exemplary continuously variable valve lift apparatus according to the present invention.

FIG. 4 is a first partial cross-sectional view showing an operation principle of a continuously variable valve lift apparatus according to various embodiments of the present invention, and FIG. 5 is a second partial cross-sectional view showing an operation principle of a continuously variable valve lift apparatus according to various embodiments of the present invention.

Referring to FIG. 4, the eccentric member 400 is mounted on the control shaft 110, the follower ring 145 is mounted on the first eccentric exterior circumference 405 of the eccentric member 400, a follower arm 515 is extended from the follower ring 145, and the follower 155 is mounted on the end portion of the follower arm 515.

If the control shaft 110 rotates in one direction, the follower ring 145, the follower arm 515, and the follower 155 move in a lower direction. That is, the principal is that the second center C2 and the third center C3 move in a lower direction in FIG. 3.

When the follower 155 moves in a lower direction and the cam 105 and the camshaft 100 rotate in a clockwise direction, the timing at which the cam 105 moves the follower 155 is advanced.

On the contrary, when the follower 155 moves in an upper direction, the timing at which the cam 105 moves the follower 155 is retarded.

The output ring 135 is mounted on the exterior circumference of the control shaft 110, and an output arm 500 is extended from the output ring 135 in a lower direction.

The output cam 300 for moving the roller of the swing arm 125 is formed in the lower end surface of the output arm 500, and a contact surface 510 is formed at the lower end surface of the output cam 300. The contact surface 510 is formed in a length direction of the swing arm 125.

The moving pin 140 is disposed at the left end portion of the output arm 500, and the moving pin 140 is elastically supported by the elastic member 130.

Referring to FIG. 5, the eccentric member 400 is mounted on the control shaft 110, and the variable ring 150 is mounted on the eccentric member 400. A variable arm 620 is extended in a lower side of the variable ring 150, and a variable pin 615 is mounted on the end portion of the variable arm 620.

More specifically, a fixed pin 605 is mounted on the follower arm 515 under the follower 155, and a first link 610 links the fixed pin 605 with the variable pin 615. Further, a second link 625 links the variable pin 615 with the moving pin 140.

The first link 610 and the second link 625 have a separated structure from each other such that if the variable arm 620 moves downward according to the rotation of the control shaft 110, the crossing angle at which the first link 610 and the second link 625 cross each other is varied.

If the variable arm 620 moves downward, the moving pin 140 moves to be closer to the camshaft 100 by the elastic member 130 so that the moving pin 140 becomes closer to the fixed pin 605.

Accordingly, in various embodiments of the present invention, the crossing angle of the lines passing the center of the control shaft 110, the center of the camshaft 100, and the center of the follower 155 are varied.

Referring to FIG. 4, if the position of the moving pin 140 moves in the direction of the camshaft 100, the position of the output cam 300, of which the lower side thereof presses the swing arm 125, is varied. That is, if the variable arm 620 moves in a lower direction, the press amount that the output cam 300 presses the swing arm 125 decreases.

Referring to FIG. 1 once more, the moving pin 140 is extended in the length direction of the control shaft 110 to connect the output arms (500, FIG. 4) that are disposed at both sides.

Figure 6:
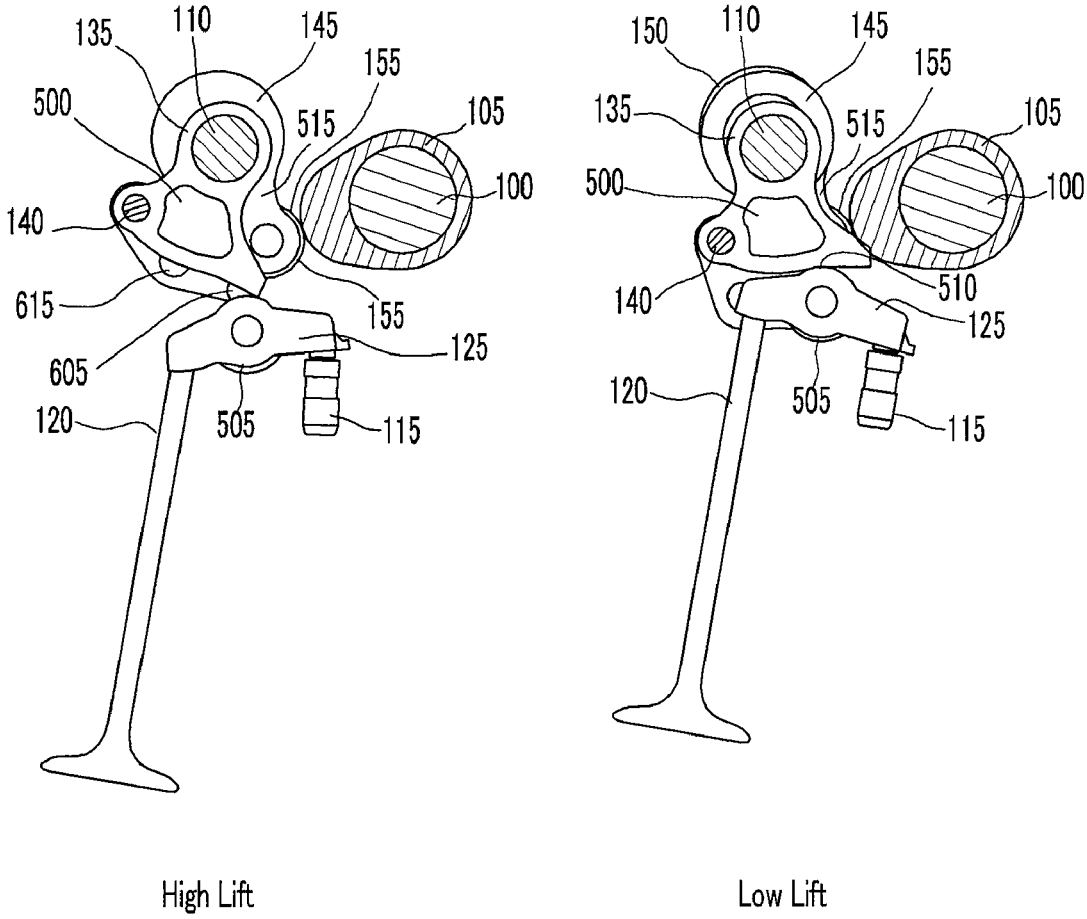
FIG. 6 is a partial cross-sectional side view showing a high lift state and a low lift state by an exemplary continuously variable valve lift apparatus according to the present invention.

FIG. 6 is a partial cross-sectional side view showing a high lift state and a low lift state by a continuously variable valve lift apparatus according to various embodiments of the present invention.

Referring to FIG. 6, the rotation position of the eccentric member 400 is varied according to the rotation position of the control shaft 110 such that the lift amount of the valve 120 is continuously varied.

Particularly, in various embodiments of the present invention, the lift amount and opening timing of the valve 120 are simultaneously varied, that is, as the lift amount of the valve 120 decreases, the maximum opening timing is advanced such that the pumping loss of the cylinder is minimized. On the contrary, as the lift amount of the valve 120 increased, the maximum opening timing is retarded.

As described above, the first and second eccentric exterior circumferences (405, 410) are formed at the exterior circumference of the eccentric member 400, and one of them adjusts the movement of the follower 155 and the other controls the movement of the output cam 300 such that the lift amount and the opening timing are simultaneously controlled by only rotating the one control shaft 110.

For convenience in explanation and accurate definition in the appended claims, the terms "lower" and "exterior" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuously variable valve lift apparatus, comprising:

a control shaft configured to be in parallel with a camshaft in which a cam is formed at one side thereof;

an eccentric member in which an insertion hole through which the control shaft penetrates is formed, and an eccentric exterior circumference is formed at an exterior circumference thereof to center on the center of one circle that is eccentric from the center of the insertion hole;

a roller type of follower that is mounted on an end portion of a follower arm that is extended from a follower ring that is slidably mounted on the eccentric member and that closely contacts the cam; and a variable ring that is slidably mounted on the eccentric member, and a variable arm is extended from the variable ring, wherein a press amount of a swing arm or timing thereof is varied by the variable arm that moves in a center direction of the control shaft or in an opposite direction thereof corresponding to a rotation of the control shaft.

2. The continuously variable valve lift apparatus of claim 1, wherein the eccentric exterior circumference includes, a first eccentric exterior circumference that corresponds to a circle that is larger than a diameter of the insertion hole to be formed in the exterior circumference of the eccentric member based on a second center eccentric from a first center of a circle following the interior circumference of the insertion hole.

3. The continuously variable valve lift apparatus of claim 2, wherein the eccentric exterior circumference further includes;

a second eccentric exterior circumference that corresponds to a circle that is larger than a diameter of the first eccentric exterior circumference to be formed in the exterior circumference of the eccentric member based on a third center eccentric from the second center wherein the follower ring is slidably mounted on the first eccentric exterior circumference, and the variable ring is slidably mounted on the second eccentric exterior circumference.

4. The continuously variable valve lift apparatus of claim 3, wherein the second eccentric exterior circumference is formed in the middle of the length direction of the eccentric member, and the first eccentric exterior circumference is respectively formed at both sides of the second eccentric exterior circumference.

5. The continuously variable valve lift apparatus of claim 3, wherein the first center, the second center, and the third center are sequentially disposed in a straight line with a predetermined distance from each other.

6. The continuously variable valve lift apparatus of claim 2, further comprising:

a variable pin that is mounted on an end portion of the variable arm;

a first link that connects a fixed pin, which is fixed to the follower arm in a lower portion of the follower, to the variable pin;

an output ring that is adjacent to the eccentric member to be slidably mounted on the exterior circumference of the control shaft;

an output arm that is extended from the output ring; and an output cam in which a contact surface is formed in one side surface of the lower end of the output arm to press a swing arm.

7. A continuously variable valve lift apparatus, comprising:

a control shaft configured to be disposed in parallel with a camshaft with a cam formed at one side thereof;

an eccentric member in which an insertion hole through which the control shaft is inserted is formed, a first eccentric exterior circumference is formed in the exterior circumference based on a second center eccentric from the first center of the circle following the interior circumference of the insertion hole corresponding to the circle larger than the diameter of the insertion hole, and a second eccentric exterior circumference is formed in the exterior circumference based on a third center eccentric from the second center;

a roller type of follower that is mounted on an end portion of the follower arm that is extended from a follower ring that is slidably engaged with the first eccentric exterior circumference to closely contact the cam; and a variable pin that is mounted on an end portion of a variable arm that is extended from a variable ring that is slidably engaged with the second eccentric exterior circumference, wherein a pressed amount of a swing arm or a press timing thereof is varied by the variable arm that moves in a center direction of the control shaft according to the rotation direction of the control shaft.

8. The continuously variable valve lift apparatus of claim 7, further comprising:

a first link that connects a fixed pin, which is fixedly mounted on the follower arm of the lower side of the follower, to the variable pin;

an output arm that is disposed adjacent to the eccentric member to be extended from the output ring, which is slidably mounted on the exterior circumference of the control shaft; and an output cam in which a contact surface is formed in one side of the output arm to press a swing arm.

9. The continuously variable valve lift apparatus of claim 8, wherein the fixed pin is mounted on one side of the follower arm, the moving pin is fixed on one side of the output arm, and the variable pin is disposed between the fixed pin and the moving pin, further comprising a second link configured to connect the fixed pin with the variable pin, and corresponding to the rotation direction of the control shaft, the variable pin moves in the center direction of the control shaft or in the opposite direction thereof such that the moving pin becomes near the fixed pin or moves away therefrom.

10. The continuously variable valve lift apparatus of claim 7, wherein the second eccentric exterior circumference is formed in the middle of the length direction of the eccentric member, and the first eccentric exterior circumference is respectively formed at both sides of the second eccentric exterior circumference.

11. The continuously variable valve lift apparatus of claim 7, wherein the first center, the second center, and the third center are sequentially disposed in a straight line with a predetermined distance from each other.

12. A continuously variable valve lift apparatus, comprising:

a control shaft configured to be in parallel with a camshaft;

an eccentric member that is mounted on the control shaft to rotate together and in which an eccentric exterior circumference is formed at an exterior circumference thereof to center on the center of one circle that is eccentric from the center of the control shaft;

wherein the press amount of a swing arm or timing thereof is varied corresponding to the rotation of the control shaft and the eccentric member;

wherein the eccentric exterior circumference includes:

a first eccentric exterior circumference that corresponds to a circle that is larger than a diameter of the control shaft to be formed in the exterior circumference of the eccentric member based on a second center eccentric from a first center of the control shaft; and a second eccentric exterior circumference that corresponds to a circle that is larger than a diameter of the first eccentric exterior circumference to be formed in the exterior circumference of the eccentric member based on a third center eccentric from the second center wherein a follower ring is slidably mounted on the first eccentric exterior circumference, and a variable ring is slidably mounted on the second eccentric exterior circumference.

13. The continuously variable valve lift apparatus of claim 12, wherein the second eccentric exterior circumference is formed in the middle of the length direction of the eccentric member, and the first eccentric exterior circumference is respectively formed at both sides of the second eccentric exterior circumference.

14. The continuously variable valve lift apparatus of claim 12, wherein the first center, the second center, and the third center are sequentially disposed in a straight line with a predetermined distance from each other.

15. A continuously variable valve lift apparatus, comprising:

a control shaft configured to be in parallel with a camshaft in which a cam is formed thereto;

an eccentric member connected to the control shaft and including at least an eccentric exterior circumference formed at an exterior circumference thereof, wherein center axes of the at least an eccentric exterior circumference are offset from a rotation axis of the control shaft;

a follower that is configured to slidably contact the cam, the follower being mounted on an end portion of a follower arm that is extended from a follower ring mounted around one of the at least an eccentric member;

a variable ring that is slidably mounted on the other of the at least an eccentric member and a variable arm is extended from the variable ring;

an output ring that is slidably mounted on the control shaft and an output arm is extended from the output ring, wherein an output cam is integrally formed to the output arm and an end portion of the output cam is pivotally coupled to one end portion of the output arm;

a first link pivotally connecting the other end portion of the follower arm and an one end portion of the variable arm; and a second link pivotally connecting the one end portion of the variable arm and the one end portion of the output arm, wherein the output cam includes a contact surface to press a swing arm and a press amount of the swing arm or timing thereof is varied by the variable arm that is rotatably controlled by the control shaft.

16. The continuously variable valve lift apparatus of claim 15, further comprising an elastic member that biases the one end portion of the output arm toward the camshaft.

* * * * *